United States Patent [19]

Tillman

[11] 4,009,758

[45] Mar. 1, 1977

[54] BLADE CONTROL APPARATUS OF A MOTOR GRADER INCLUDING WAND VIBRATION DAMPING ELEMENT

[75] Inventor: William R. Tillman, Monticello, Ill.

[73] Assignee: Caterpillar Tractor Co., Peoria, Ill.

[22] Filed: Sept. 22, 1975

[21] Appl. No:: 615,653

[52] U.S. Cl. ..... 172/4.5; 200/61.44

[51] Int. Cl.[2] ..... A01B 65/06; E02F 3/76

[58] Field of Search ..... 172/4.5; 404/84; 37/DIG. 20; 24/16 PB, 81 G, 81 CC, 132 SB, 137 R, 137 A, 81 TH, 129 D, 252 A, 255 R, 255 C, 255 GP, 255 VA; 226/198; 242/157 R; 403/13, 14; 248/60, 61, 68 R, 230, 231, 500, 509; 223/90, 91, 92, 93, 96; 200/61.44; 33/185 V

[56] References Cited

UNITED STATES PATENTS

| | | | |
|---|---|---|---|
| 432,809 | 7/1890 | Weaver | 24/255 GP |
| 1,336,375 | 4/1920 | Owen | 223/90 |
| 1,360,189 | 11/1920 | Cushing | 24/129 D UX |
| 1,799,717 | 4/1931 | Wilson | 24/255 GP |
| 1,906,058 | 4/1933 | Gray | 223/93 |
| 1,917,086 | 7/1933 | Beauchamp | 223/92 |
| 3,495,663 | 2/1970 | Scholl et al. | 172/4.5 |
| 3,561,538 | 2/1971 | Curlett et al. | 172/4.5 |
| 3,743,026 | 7/1973 | Gill et al. | 172/4.5 |

*Primary Examiner*—Richard T. Stouffer
*Attorney, Agent, or Firm*—Frank L. Hart

[57] ABSTRACT

An improved control apparatus of a motor grader for maintaining the grader blade relative to a reference line has a biasing element connected to an actuating wand and associated with the reference line for urging the reference line toward the actuating wand of the controls at a preselected force for damping undesirable vibrations of the wand.

5 Claims, 3 Drawing Figures

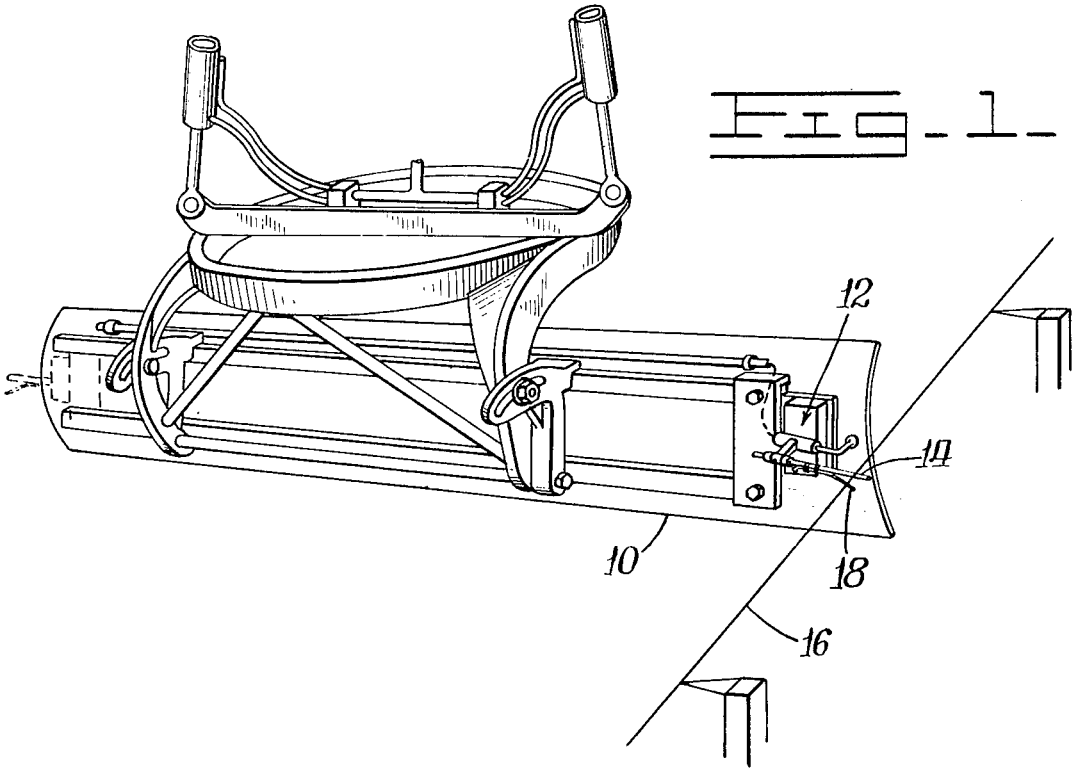
Fig. 1.
Fig. 2.
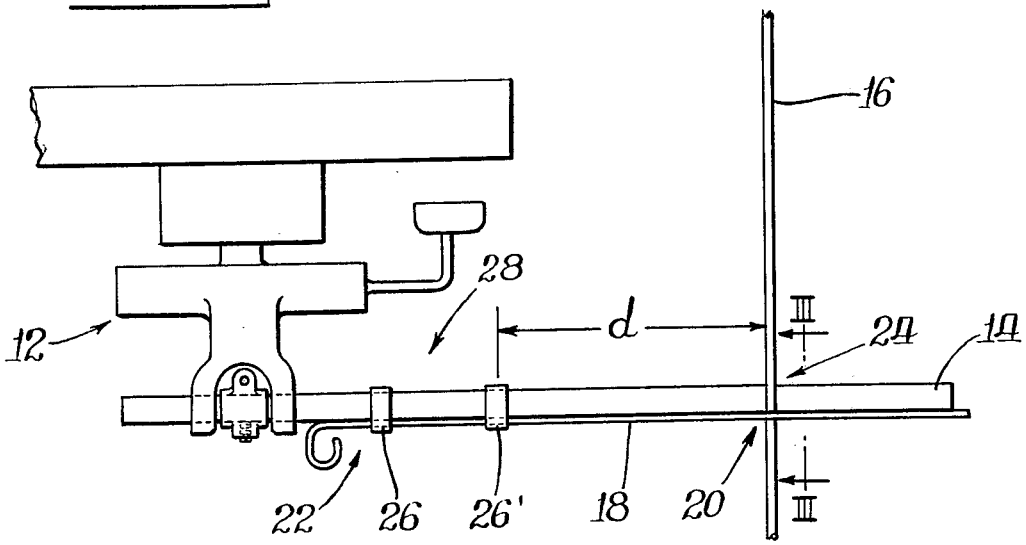
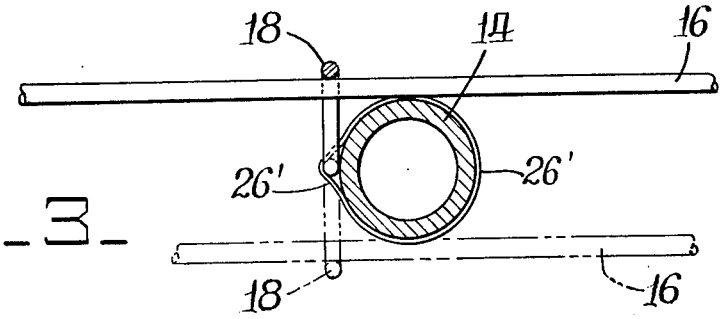
Fig. 3.

BLADE CONTROL APPARATUS OF A MOTOR GRADER INCLUDING WAND VIBRATION DAMPING ELEMENT

BACKGROUND OF THE INVENTION

Blade control apparatus of a motor grader, as for example shown in U.S. Pat. No. 3,561,538 which issued Feb. 9, 1971 to Curlitt from an application filed Aug. 25, 1969, has an actuating wand that is associated with a reference line. The wand travels along the reference line during grading operations and the grader blade is maintained substantially parallel with the reference line in response to the actuating wand of the control apparatus being vertically moved by the reference line.

Since the reference line is usually a wire line extending along the area to be graded and is supported by stakes driven into the ground, the actuating wand sometimes impacts a stake. This impact is sometimes relatively severe when the grading speed is high and/or the stake is improperly oriented.

Although the associated blade control apparatus for the wand has vibration damping dash pots or other means, it has been determined that supplemental stabilizing means can improve the performance of the control means by damping out sudden impact forces while permitting the control apparatus to be maintained relatively sensitive to continuing force subjected on the wand by elevation changes of the reference line.

This invention therefore resides in improved control apparatus for damping vibrations of an actuating wand of blade control apparatus of a motor grader.

BRIEF DESCRIPTION OF THE DRAWINGS

FIG. 1 is a diagrammatic perspective view of the blade control apparatus and the blade of a motor grader.

FIG. 2 is a diagrammatic top view of the apparatus, and

FIG. 3 is a diagrammatic end view in partial section of the apparatus.

DETAILED DESCRIPTION OF THE INVENTION

Referring to FIG. 1, a blade 10 of a motor grader has blade control apparatus 12 associated therewith, as more fully described in the above cited patent which is hereby incorporated by reference. The control apparatus 12 has an actuating wand 14 extending outwardly therefrom for contact with a reference line 16. In the operation of the apparatus, the wand follows the reference line during grading operations. As the wand 14 is vertically moved by the reference line 16, the control apparatus 12 causes the blade 10 to move in response to movements of the wand 14 for maintaining the bottom edge of the blade 10 along a pathway substantially parallel to the reference line 16.

In the improved controls of this invention, a biasing means 18 is associated with the wand 14 for contacting the reference line 16 and urging said reference line 16 at a preselected force toward contact with the first end portion of the wand.

Referring to the embodiment of FIGS. 2 and 3, the biasing means is an elongated biasing element 18 which has first and second end portions 20, 22 and extends generally along the wand 14. the biasing element 18 is of a flexibility sufficient for receiving the reference line 16 between first end portions 20, 24 of the respective biasing element 18 and the wand 14 and biasing the reference line 16 toward the wand 14.

Connecting means, such as, for example, metal bands 26,26' connect only the second end portion 22 of the biasing element 18 to only the second end portion 28 of the wand 14. By this connection, a moment arm of length *d* is provided between the connection means 26 and forces that are exerted on the first end portions 20, 24 of the respective biasing element 18 and wand 14. Impact forces subjected on the wand 14 and/or biasing element 18, by hitting a stake or other structure, causes reaction forces between the wand 14 and biasing element 18 at the connections 26, 26'. These reaction forces function to damp the vibration of the wand 14 and stabilize the operation of the control apparatus and associated blade 10. Where the biasing element 12 is not used on the wand 14, vibrations of the wand 14 can cause the blade to undesirably vertically oscillate for a considerable distance along the work surface.

It is preferred that the distance between the connecting means 26 and the reference line contacting portions of the wand 14 and biasing element be at least about 10 cm. for providing a moment arm of sufficient magnitude. It is also preferred that the connecting bands 26, 26' be spaced at least about 3 cm. one from the other for transmitting the forces through a lever arm system and thereby produce additional vibration damping.

The biasing element 18 preferably is of a construction for urging the reference line 16 toward the wand 14 at a preselected force of at least 15 gms. A preselected force less than about 15 gms. is undesirable because the wand biasing element 18 would not be sufficiently maintained relative to the reference line 16 to provide vibration damping of a desirable magnitude which would result in vibrations continuing for an undesirable length of time.

As can be seen from a study of the drawings, it is desirable that the elongated biasing element 18, such as a steel wire, be associated with connecting elements 26, 26' of the construction sufficient for rotating the biasing element 18 in the connecting means 26 for operation of the biasing means 18 and reference line 16 at a location either above the wand 14 as shown by solid lines in FIG. 3 or below the reference line 16 as shown by broken lines in FIG. 3. It is preferred to operate with the reference line 16 above the wand 14 on generally downwardly depending grades and along the wand 14 where the line 16 extends generally upwardly from the work surface.

Other aspects, objects, and advantages of this invention will become apparent from a study of the drawings, specification, and depending claims and it should be understood that this invention is not to be unduly restricted thereto.

What is claimed is:

1. In control apparatus of a blade of a motor grader having a wand extending outwardly from associated controls for contact with a reference line for causing the blade to follow a pathway substantially parallel to the reference line in response to vertical movement of the wand as the wand passes along the reference line, said wand having a first end portion for contacting the reference line connected to the associated controls, the improvement comprising:

biasing means including a flexible means having a substantially smaller cross-section than said wand and flexibly associated therewith for contacting the reference line and urging said reference line toward the first end portion of the wand at a preselected force said biasing means and said wand exerting reaction forces therebetween upon impact forces being subjected upon at least one of said wand and said biasing means while said reference line is therebetween for damping vibrations of the wand while permitting said reference line to move to positions spaced from the wand during said vibrations with said reference line being sufficiently maintained relative to said flexible means to provide a desirable magnitude of vibration damping upon said wand.

2. Apparatus, as set forth in claim 1, wherein the biasing means comprises:

said flexible means being an elongated biasing element having first and second end portions and extending along the wand, said biasing element being of a flexibility sufficient for receiving the reference line between the first end portions of the biasing element and the wand and biasing the reference line toward the wand, and means connecting only the second end portion of the biasing element to only the second end portion of the wand for providing moment arms between said connecting means and the first end portions of the wand and biasing element.

3. Apparatus, as set forth in claim 2, wherein the distance between the connecting means and the first end portions of the wand and biasing element is at least about 10 cm.

4. Apparatus, as set forth in claim 2 wherein the connecting means is of a construction sufficient for rotating the biasing element in the connecting means.

5. Apparatus, as set forth in claim 1, wherein the biasing means is of a construction sufficient for urging the reference line toward the wand at said preselected force, said preselected force being at least 15 gms.

* * * * *